US005300420A

United States Patent [19]

Kenney et al.

[11] Patent Number: 5,300,420

[45] Date of Patent: Apr. 5, 1994

[54] STABILIZERS FOR PHOTOTHERMOGRAPHY WITH NITRILE BLOCKING GROUPS

[75] Inventors: Raymond J. Kenney, Woodbury; Larry R. Krepski, White Bear Lake, both of Minn.

[73] Assignee: Minnesota Mining and Manufacturing Company, St. Paul, Minn.

[21] Appl. No.: 69,517

[22] Filed: Jun. 1, 1993

[51] Int. Cl.[5] ..... G03C 1/06; G03C 1/00

[52] U.S. Cl. ..... 430/615; 430/613; 430/614; 430/617; 430/619; 430/955; 430/965

[58] Field of Search ..... 430/600, 611, 613, 614, 430/615, 617, 619, 955, 965

[56] References Cited

U.S. PATENT DOCUMENTS

| | | | |
|---|---|---|---|
| 3,877,940 | 4/1975 | Ericson | 430/617 |
| 4,511,650 | 4/1985 | Hirai et al. | 430/619 |
| 4,610,957 | 9/1986 | Kato et al. | 430/619 |
| 4,657,848 | 4/1987 | Sato et al. | 430/617 |
| 4,849,324 | 7/1989 | Aida et al. | 430/611 |
| 4,983,494 | 1/1991 | Kitaguchi et al. | 430/617 |
| 5,082,763 | 1/1992 | Kojima et al. | 430/611 |

FOREIGN PATENT DOCUMENTS 2235940 10/1987 Japan .

OTHER PUBLICATIONS

U.S. Defensive Publication T864,022, Beavers et al., Jul. 1969.

*Primary Examiner*—Charles L. Bowers, Jr.
*Assistant Examiner*—J. Pasterczyk
*Attorney, Agent, or Firm*—Gary L. Griswold; Walter N. Kirn; Mark A. Litman

[57] ABSTRACT

Photothermographic compositions comprising a photographic silver halide, an organic silver salt, and a reducing agent for the organic silver salt, display improved stabilty in the presence of a compound having a nucleus of the formula:

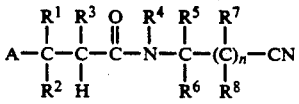

wherein:

A represents any monovalent group for which the corresponding compound AH functions as a post-processing stabilizer, $R^1$, $R^2$, and $R^3$, are independently hydrogen or methyl and with the proviso that $R^1$ can represent an aryl group when $R^2$ and $R^3$ are hydrogen;

$R^4$ is hydrogen or lower alkyl of from 1 to 4 carbon atoms;

$R^5$ and $R^6$ independently represent hydrogen, an alkyl group, a cycloalkyl group, an aryl group or $R^5$ and $R^6$ taken together with the carbon atom to which they are joined form a ring of 4 to 12 atoms;

$R^7$ and $R^8$ are independently hydrogen or lower alkyl of 1 to 4 carbon atoms; and n is 0 or 1.

17 Claims, No Drawings

STABILIZERS FOR PHOTOTHERMOGRAPHY WITH NITRILE BLOCKING GROUPS

BACKGROUND OF THE INVENTION

1. Field of the Invention

This invention relates to photothermographic materials and in particular to post-processing stabilization of photothermographic silver-containing materials.

2. Background of the Art

Silver halide containing photothermographic imaging materials processed with heat, and without liquid development have been known in the art for many years. These materials, also known as dry silver materials, generally comprise a support having thereon a photographic light-sensitive silver halide, a light-insensitive organic silver salt, and a reducing agent for the organic silver salt.

The light-sensitive silver halide is in catalytic proximity to the light-insensitive organic silver salt so that the latent image, formed by irradiation of the silver halide, serves as a catalyst nucleus for the oxidation-reduction reaction of the organic silver salt with the reducing agent when the emulsion is heated above about 80° C. Such media are described, for example, in U.S. Pat. Nos. 3,457,075, 3,839,049, and 4,260,677. The silver halide may also be generated in the media by a preheating step in which halide ion is released to form silver halide.

A variety of ingredients may be added to these basic components to enhance performance. For example, toning agents may be incorporated to improve the color of the silver image of the photothermographic emulsions, as described in U.S. Pat. Nos. 3,846,136; 3,994,732 and 4,021,249. Various methods to produce dye images and multicolor images with photographic color couplers and leuco dyes are known and described in U.S. Pat. Nos. 4,022,617; 3,531,286; 3,180,731; 3,761,270, 4,460,681; 4,883,747 and *Research Disclosure*, March 1989, item 29963.

A common problem that exists with photothermographic systems is post-processing instability of the image. The photoactive silver halide still present in the developed image may continue to catalyze print-out of metallic silver during room light handling or exposure to heat or humidity. Thus, there exists a need for stabilization of the unreacted silver halide. The addition of separate post-processing image stabilizers has been used to impart post-processing stability. Most often these are sulfur-containing compounds such as mercaptans, thiones, and thioethers as described in *Research Disclosure*, June 1978, item 17029. U.S. Pat. Nos. 4,245,033; 4,837,141 and 4,451,561 describe sulfur compounds that are development restrainers for photothermographic systems. Mesoionic 1,2,4-triazolium-3-thiolates as fixing agents and silver halide stabilizers are described in U.S. Pat. No. 4,378,424. Substituted 5-mercapto-1,2,4-triazoles such as 3-amino-5-benzothio-1,2,4-triazole as post-processing stabilizers are described in U.S. Pat. Nos. 4,128,557; 4,137,079; 4,138,265, and *Research Disclosure*, May 1978, items 16977 and 16979. U.S. Pat. Nos. 5,158,866 and 5,194,623 describe the use of omega-substituted 2-propionamidoacetyl or 3-propionamidopropionyl stabilizer precursors as post-processing stabilizers in photothermographic emulsions. U.S. Pat. No. 5,175,081 discribes the use of certain azlactones as stabilizers.

Problems arising from the addition of stabilizers may include thermal fogging during processing and losses in photographic speed, maximum density or contrast at effective stabilizer concentrations.

Stabilizer precursors are materials which have blocking or modifying groups that are usually cleaved during processing with heat and/or alkali. The cleaving provides the primary active stabilizer which can combine with the photoactive silver halide in the unexposed and undeveloped areas of the photographic material. For example, in the presence of a stabilizer precursor in which a sulfur atom is unblocked upon processing, the resulting silver mercaptide will be more stable than the silver halide to light, atmospheric, and ambient conditions.

Various blocking techniques have been utilized in developing the stabilizer precursors. U.S. Pat. No. 3,615,617 describes acyl blocked photographically useful stabilizers. U.S. Pat. Nos. 3,674,478 and 3,993,661 describe hydroxyarylmethyl blocking groups. Benzylthio releasing groups are described in U.S. Pat. No. 3,698,898. Thiocarbonate blocking groups are described in U.S. Pat. No. 3,791,830, and thioether blocking groups in U.S. Pat. Nos. 4,335,200, 4,416,977, and 4,420,554. Photographically useful stabilizers which are blocked as urea or thiourea derivatives are described in U.S. Pat. No. 4,310,612. Blocked imidomethyl derivatives are described in U.S. Pat. No. 4,350,752, and imide or thioimide derivatives are described in U.S. Pat. No. 4,888,268. Removal of all of these aforementioned blocking groups from the photographically useful stabilizers is accomplished by an increase of pH during alkaline processing conditions of the exposed imaging material.

Thermally sensitive blocking groups are also known. These blocking groups are removed by heating the imaging material during processing. Photographically useful stabilizers blocked as thermally sensitive carbamate derivatives are described in U.S. Pat. Nos. 3,844,797 and 4,144,072. These carbamate derivatives presumably regenerate the photographic stabilizer through loss of an isocyanate. Hydroxymethyl blocked photographic reagents which are deblocked through loss of formaldehyde during heating are described in U.S. Pat. No. 4,510,236. Development inhibitor releasing couplers releasing tetrazolylthio moieties are described in U.S. Pat. No. 3,700,457. Substituted benzylthio releasing groups are described in U.S. Pat. No. 4,678,735. U.S. Pat. Nos. 4,351,896 and 4,404,390 utilize carboxybenzylthio blocking groups for mesoionic 1,2,4-triazolium-3-thiolate stabilizers. Photographic stabilizers that are blocked by a Michael-type addition to the carbon-carbon double bond of either acrylonitrile or alkyl acrylates are described in U.S. Pat. Nos. 4,009,029 and 4,511,644, respectively. Heating of these blocked derivatives causes unblocking by a retro-Michael reaction.

Various disadvantages attend these different blocking techniques. Highly basic solutions necessary to cause deblocking of the alkali sensitive blocked derivatives are corrosive and irritating to the skin. With photographic stabilizers that are blocked with a heat removable group, it is often found that the liberated reagent or by-product can react with other components of the imaging construction and cause adverse effects. Also, inadequate or premature release of the stabilizing moiety during heat processing may occur.

There has been a continued need for improved post-processing stabilizers or stabilizer precursors that do not fog or desensitize photothermographic materials, and for stabilizer precursors that release the stabilizing moiety at the appropriate time and do not have any detrimental effects on the photosensitive material or its user.

Blocking groups which are removed by actinic radiation are discussed in the context of organic synthesis utility in Amit et al., *Israel J. Chem.* 1974, 12, 103; and V. N. R. Pillai, *Synthesis*, 1980, 1–26. The o-nitrobenzyl group has been known as a photocleavable blocking group for some time (J. Barltrop et al, *J. Chem. Soc. Chem. Comm.* 1966, 822–823.) Various substituted analogues have been prepared in order to maximize the photochemical efficiency and chemical yield, and to suppress colored products of the photolysis. The o-nitrobenzyl group has been used to protect many different functional groups, including carboxylic acids, amines, phenols, phosphates, and thiols.

Photolytically active stabilizer precursors for photothermographic silver imaging compositions which apparently release bromine atoms are described in U.S. Pat. No. 4,459,350.

U.S. Pat. No. 4,207,108 describes the use of thione compounds as a photographic speed enhancing additive, U.S. Pat. No. 4,873,184 describes the use of metal chelating agents to enhance speed in silver halide systems, and U.S. Pat. No. 4,264,725 describes the use of benzyl alcohol and 2-phenoxyethanol as speed enhancing solvents for photothermographic materials.

Stabilizer precursors of the present invention can be added to photothermographic formulations without the necessity of rebalancing the formulation to compensate for effects on sensitometry, as is often the case with other stabilizers in the art.

SUMMARY OF THE INVENTION

In one aspect this invention relates to photothermographic articles comprising a photothermographic composition coated on a substrate wherein the photothermographic composition comprises a photosensitive silver salt, an organic silver salt, and a reducing agent for the organic silver salt, and a post-processing stabilizer having a central nucleus of the formula:

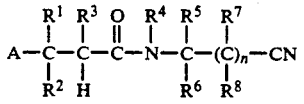

wherein:

A represents a post-processing stabilizer group in which a hydrogen atom of the post-processing stabilizer (AH) has been replaced by

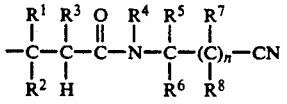

$R^1$, $R^2$, and $R^3$, are independently hydrogen or methyl and with the proviso that $R^1$ can represent an aryl group when $R^2$ and $R^3$ are hydrogen;

$R^4$ can be hydrogen or lower alkyl (of from 1 to 4 carbon atoms);

$R^5$ and $R^6$ independently represent hydrogen, an alkyl group, a cycloalkyl group, an aryl group or $R^5$ and $R^6$ taken together with the carbon atom to which they are joined form a ring of 4 to 12 atoms;

$R^7$ and $R^8$ are independently hydrogen or lower alkyl of 1 to 4 carbon atoms; and n is 0 or 1;

Preferably the compound has the formula:

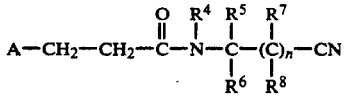

wherein:

A represents any monovalent group for which the corresponding compound AH functions as a post-processing stabilizer having from 1 to 50 carbon atoms. The A groups may of course independently bear substituents that are photographically inert or physically useful (e.g., solubilizing, ballasting, etc.) and the substituent may be independently represented by a group R selected from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonio, phosphonio, silyl, and silyloxy groups having up to 18 carbon atoms, and wherein any two or three R groups such as $R^9$, $R^{10}$, and $R^{11}$ may together form a fused ring structure with any central benzene ring.

The compounds of the present invention typically comprise from about 0.01 wt % to 10 wt % of the dry photothermographic composition. They may be incorporated directly into the silver containing layer or into an adjacent layer. The stabilizers of the invention are especially useful in articles and compositions for the preparation of photothermographic color and photothermographic black-and-white images.

The stabilizers of the present invention stabilize silver halide and/or minimize untimely leuco oxidation for improved post-processing stabilization without desensitization or fogging during heat processing.

The stabilizers of this invention are believed to be deblocked to release the parent stabilizer by the action of heat and therefore offer advantages over unprotected stabilizers and stabilizers released by other mechanisms by being inert and inactive during the processing step, and being resistant to thermal release during shelf aging. They are only released when they are needed. They are useful in a wide range of photothermographic media and processing conditions, since they do not appear to have specific requirements for release that attend most other masking groups.

Whether or not specifically describing substituents, substitution is anticipated on the compounds of the present invention. Where the term "group" or "nucleus" is used, these terms include the use of additional substituents beyond the literal definition of alkyl or the nucleus. For example, alkyl group includes ether groups (e.g., $CH_3$—$CH_2$—$CH_2$—O—$CH_2$—), haloalkyls, nitroalkyls, carboxyalkyls, hydroxyalkyls, sulfoalkyls, etc. while the term "alkyl moiety" or "alkyl radical" or "alkyl moiety" includes only hydrocarbons. Substituents which react with active ingredients, such as very strongly electrophilic or oxidizing substituents, would of course be excluded by the ordinarly skilled artisan as not being inert or harmless.

DETAILED DESCRIPTION OF THE INVENTION

Photothermographic articles of the present invention comprise a photothermographic composition coated on a substrate wherein the photothermographic construction comprises a photographic silver salt, an organic silver salt, a reducing agent for the organic silver salt, and a stabilizer having the formula:

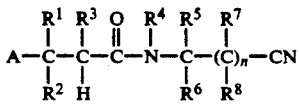

wherein:

A represents a post-processing stabilizer in which a hydrogen atom of the post-processing stabilizer (AH) has been replaced by

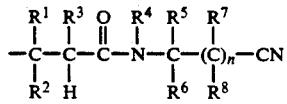

$R^1$, $R^2$, and $R^3$, are independently hydrogen or methyl and with the proviso that $R^1$ can represent an aryl group when $R^2$ and $R^3$ are hydrogen;

$R^4$ can be hydrogen or lower alkyl of from 1 to 4 carbon atoms;

$R^5$ and $R^6$ independently represent hydrogen, an alkyl group, a cycloalkyl group, an aryl group or $R^5$ and $R^6$ taken together with the carbon atom to which they are joined form a ring of 4 to 12 atoms;

$R^7$ and $R^8$ are independently hydrogen or lower alkyl of 1 to 4 carbon atoms; and n is 0 or 1;

Preferably the compound has the formula:

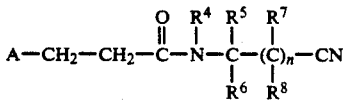

wherein:

A represents any monovalent group for which the corresponding compound AH functions as a post-processing stabilizer having from 1 to 50 carbon atoms. The A groups may of course independently bear substituents that are photographically inert or physically useful (e.g., solubilizing, ballasting, etc.) and the substituent may be independently represented by a group R selected from hydrogen, alkyl, alkoxycarbonyl, alkenyl, aryl, hydroxy, mercapto, amino, amido, thioamido, carbamoyl, thiocarbomoyl, cyano, nitro, sulfo, carboxyl, fluoro, formyl, sulfoxyl, sulfonyl, hydrodithio, ammonio, phosphonio, silyl, and silyloxy groups having up to 18 carbon atoms in any one of these groups, and wherein any two or three R groups such as $R^9$, $R^{10}$, and $R^{11}$ may together form a fused ring structure with any central benzene ring.

In photothermographic articles of the present invention the layer(s) that contain the photographic silver salt are referred to herein as emulsion layer(s). According to the present invention the blocked stabilizer is added either to one or more emulsion layers or to a layer or layers adjacent to one or more emulsion layers. Layers that are adjacent to emulsion layers may be, for example, primer layers, image-receiving layers, interlayers, opacifying layers, antihalation layers, barrier layers, auxiliary layers, etc.

The bridging group acts as a blocking group to block the activity of the primary stabilizer AH. If AH is left unblocked and added to the photothermographic emulsion at the same molar equivalent concentration as the blocked compound, AH desensitizes or fogs the emulsion. Deblocking to release the active stabilizer occurs after exposure and development at elevated temperatures. Thus, the blocked stabilizers of the present invention overcome the problems of desensitization and fogging that occur when the stabilizers are use in their unblocked form.

A is preferably attached through a nitrogen atom. Post-processing stabilizing groups for stabilizing silver ion AH usually have a heteroatom such as nitrogen available for complexing silver ion. The compounds are usually ring structures with the heteroatom within the ring or external to the ring. These compounds are well known to one ordinarily skilled in the photographic art. Non-limiting examples of AH include nitrogen-containing heterocycles, substituted or unsubstituted, including but not limited to, imidazoles such as benzimidazole and benzimidazole derivatives; triazoles such as benzotriazole, 1,2,4-triazole, 3-amino-1,2,4-triazole, and 2-thioalkyl-5-phenyl-1,2,4-triazoles; tetrazoles such as 5-amino tetrazole and phenylmercaptotetrazole; triazines such as mercaptotetrahydrotriazine; piperidones; tetraazaindans; 8-azaguanine; thymine; thiazolines such as 2-amino-2-thiazoline, indazoles; hypoxanthines; pyrazolidinones 2H-pyridooxazin-3(4H)-one and other nitrogen-containing heterocycles; or any such compound that stabilizes the emulsion layer, and particularly those that have deleterious effects on the initial sensitometry or excessive fog is used unblocked.

Many of such compounds are summarized in *Research Disclosure*, March 1989, item 29963. AH may also be a compound which stabilizes a leuco dye, usually a reducing agent which has an active hydrogen which can be masked by replacement with the blocking group. An example of a useful reducing agent is 1-phenyl-3-pyrazolidinone (described in U.S. Pat. No. 4,423,139 for stabilizing leuco dyes). Masking of such reducing agents during the processing step is usually necessary since they may act as developers or development accelerators to cause unacceptable fogging.

Non-limiting representative examples of stabilizer groups A-according to the present invention are:

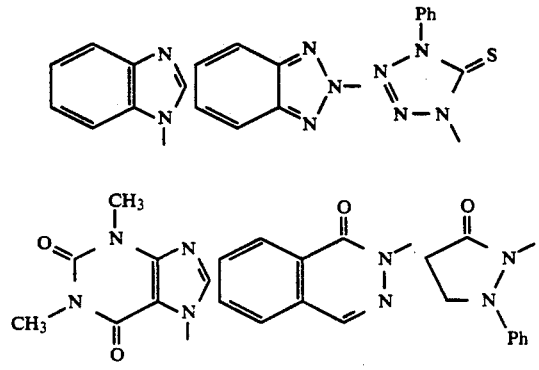

-continued

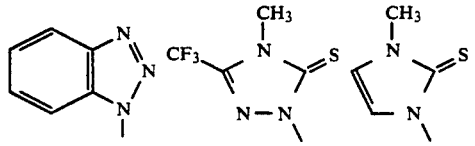

Non-limiting examples of protected stabilizers according to the present invention are:

Compound 1

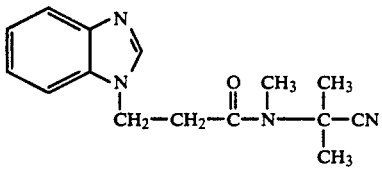

Compound 2

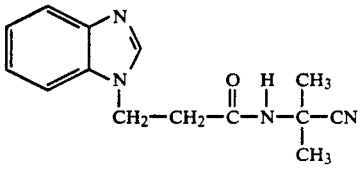

Compound 3

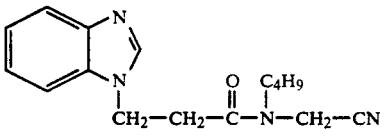

Compound 4

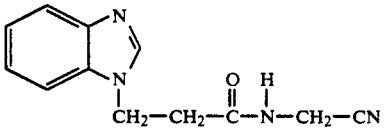

Compound 5

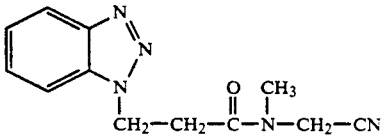

Compound 6

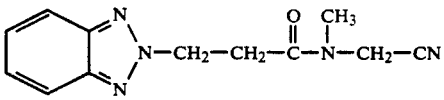

Compound 7

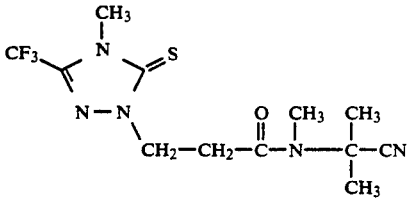

Compound 8

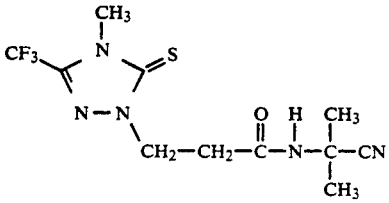

-continued

Compound 9

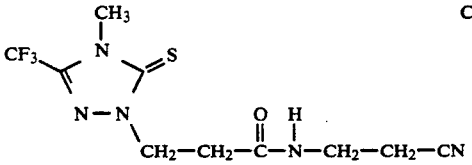

Compound 10

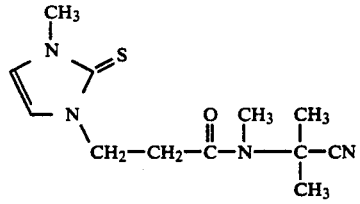

Compound 11

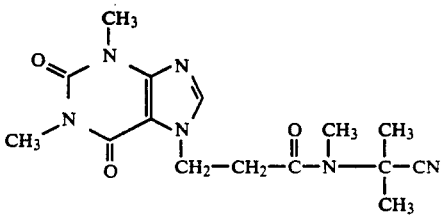

Compound 12

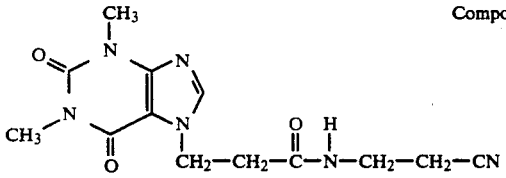

Compound 13

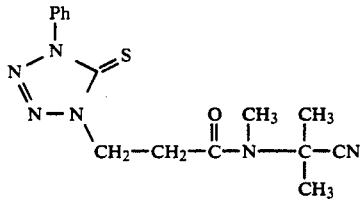

Compound 14

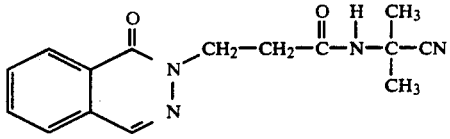

Compound 15

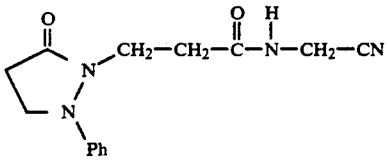

Compound 16

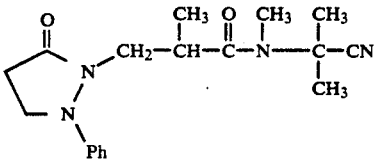

Photothermographic articles of the invention may contain other post-processing stabilizers or stabilizer precursors in combination with the compounds of the invention, as well as other additives in combination with the compound of the invention such as shelf-life stabilizers, toners, development accelerators and other image modifying agents.

The amounts of the above described stablizer ingredients that are added to the emulsion layer according to the present invention may be varied depending upon the particular compound used and upon the type of emulsion layer (i.e., black and white or color). However, the ingredients are preferably added in an amount of 0.01 to 100 mol per mole of silver halide, and more preferably from 0.1 to 50 mol per mol of silver halide in the emulsion layer.

The photothermographic dry silver emulsions of this invention may be constructed of one or more layers on a substrate. Single layer constructions must contain the silver source material, the silver halide, the developer and binder as well as any optional additional materials such as toners, coating aids, and other adjuvants. Two-layer constructions must contain the silver source and silver halide in one emulsion layer (usually the layer adjacent to the substrate) and some of the other ingredients in the second layer or both layers, although two layer constructions comprising a single emulsion layer containing all the ingredients and a protective topcoat are envisioned. Multicolor photothermographic dry silver constructions may contain sets of these bilayers for each color, or they may contain all ingredients within a single layer as described in U.S. Pat. No. 4,708,928. In the case of multilayer multicolor photothermographic articles the various emulsion layers are generally maintained distinct from each other by the use of functional or non-functional barrier layers between the various photosensitive layers as described in U.S. Pat. No. 4,460,681.

While not necessary for practice of the present invention, it may be advantageous to add mercury (II) salts to the emulsion layer(s) as an antifoggant. Preferred mercury (II) salts for this purpose are mercuric acetate and mercuric bromide.

The light sensitive silver halide used in the present invention may typically be employed in a range of 0.75 to 25 mol percent and, preferably, from 2 to 20 mol percent of organic silver salt.

The silver halide may be any photosensitive silver halide such as silver bromide, silver iodide, silver chloride, silver bromoiodide, silver chlorobromoiodide, silver chlorobromide, etc. The silver halide may be in any form which is photosensitive including, but not limited to cubic, orthrohombic, tabular, tetrahedral, etc., and may have epitaxial growth of crystals thereon.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T. N. James *The Theory of the Photographic Process*, Fourth Edition, Chapter 5, pages 149 to 169.

The silver halide may be added to the emulsion layer in any fashion which places it in catalytic proximity to the silver source. Silver halide and the organic silver salt which are separately formed or "preformed" in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are known in the art and described in *Research Disclosure*, June 1978, item 17029, and U.S. Pat. No. 3,700,458.

The use of preformed silver halide emulsions of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to cubic, tetrahedral, orthorhombic, tabular, laminar, platelet, etc.

The light-sensitive silver halides may be advantageously spectrally sensitized with various known dyes including cyanine, merocyanine, styryl, hemicyanine, oxonol, hemioxonol and xanthene dyes. Useful cyanine dyes include those having a basic nucleus, such as thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Practically, the sensitizing dyes to be used in the present invention may be properly selected from known dyes such as those described in U.S. Pat. Nos. 3,761,279, 3,719,495, and 3,877,943, British Pat. Nos. 1,466,201, 1,469,117 and 1,422,057, and can be located in the vicinity of the photocatalyst according to known methods. Spectral sensitizing dyes may be typically used in amounts of about $10^{-4}$ mol to about 1 mol per 1 mol of silver halide.

The organic silver salt which can be used in the present invention is a silver salt which is comparatively stable to light, but forms a silver image when heated to 80° C. or higher in the presence of an exposed photocatalyst (such as photographic silver halide) and a reducing agent.

The organic silver salt may be any organic material which contains a reducible source of silver ions. Silver salts of organic acids, particularly long chain (10 to 30 preferably 15 to 28 carbon atoms) fatty carboxylic acids are preferred. Complexes of organic or inorganic silver salts wherein the ligand has a gross stability constant between 4.0 and 10.0 are also desirable. The silver source material should preferably constitute from about 5 to 30 percent by weight of the imaging layer.

Preferred organic silver salts include silver salts of organic compounds having a carboxy group. Non-limiting examples thereof include silver salts of an aliphatic carboxylic acid and a silver salt of an aromatic carboxylic acid Preferred examples of the silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate and silver camphorate, mixtures thereof, etc. Silver salts with a halogen atom or a hydroxyl on the aliphatic carboxylic acid can also be effectively used. Preferred examples of the silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamido-benzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can also be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, a silver salt of thioglycolic acid such as a silver salt of an S-alkyl thioglycolic acid (wherein the alkyl group has from 12 to 22 carbon atoms), a silver salt of a dithiocarboxylic acid such as a silver salt of dithioacetic acid, a silver salt of a thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group may be used. Preferred examples of these compounds include silver salts of benzothiazole and derivatives thereof, for example, silver salts of benzothiazoles such as silver methylbenzotriazolate, etc., silver salt of halogen-substituted benzotriazoles, such as silver 5-chlorobenzotriazolate, etc., silver salts of carboimidobenzotriazole, etc., silver salt of 1,2,4-triazoles or 1-H-tetrazoles as described in U.S. Pat. No. 4,220,709, silver salts of imidazoles and imidazole derivatives, and the like. Various silver acetylide compounds can also be used, for instance, as described in U.S. Pat. Nos. 4,761,361 and 4,775,613.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver may be used.

The method used for making silver soap dispersions is well known in the art and is disclosed in *Research Disclosure*, April 1983, item 22812, *Research Disclosure*, October 1983, item 23419 and U.S. Pat. No. 3,985,565.

The reducing agent for the organic silver salt may be any material, preferably organic material, that can reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent tend to be more desirable.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine, a reductone and/or a hydrazine (e.g., a combination of hydroquinone and bis(ethoxyethyl)hydroxylamine, piperidinohexose reductone or formyl-4-methylphenylhydrazine); hydroxamic acids such as phenylhydroxamic acid, p-hydroxyphenylhydroxamic acid, and β-alaninehydroxamic acid; a combination of azines and sulfonamidophenols, (e.g., phenothiazine and 2,6-dichloro-4-benzenesulfonamidophenol); α-cyanophenylacetic acid derivatives such as ethyl-α-cyano-2-methylphenylacetate, ethyl α-cyanophenylacetate; bis-β-naphthols as illustrated by 2,2'-dihydroxyl-1,1'-binaphthyl, 6,6'-dibromo-2,2'-dihydroxy-1,1'-binaphthyl, and bis(2-hydroxy-1-naphthyl)methane; a combination of bis-β-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidonehexose reductone; sulfonamido-phenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridine; bisphenols (e.g., bis(2-hydroxy-3-t-butyl-5-methylphenyl)methane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane); ascorbic acid derivatives (e.g., 1-ascorbyl palmitate, ascorbyl stearate); and aldehydes and ketones, such as benzil and biacetyl; 3-pyrazolidones and certain indane-1,3-diones.

In addition to the aforementioned ingredients it may be advantageous to include additives known as "toners" that improve the image. Toner materials may be present, for example, in amounts from 0.1 to 10 percent by weight of all silver bearing components. Toners are well-known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and quinazolinone, 3-phenyl-2-pyrazoline-5-one, 1-phenylurazole, quinazoline, and 2,4-thiazolidinedione; naphthalimides (e.g., N-hydroxy-1,8-naphthalamide); cobalt complexes (e.g., cobaltic hexammine trifluoroacetate); mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, (e.g., (N,N-dimethylaminomethyl)phthalimide, and N,N-(dimethylaminomethyl)naphthalene-2,3-dicarboximide); and a combination of blocked pyrazoles, isothiuronium derivatives and certain photobleaching agents (e.g., a combination of N,N'-hexamethylene bis(1-carbamoyl-3,5-dimethylpyrazole), 1,8-(3,6-diazaoctane)bis(isothiuronium trifluoroacetate) and 2-(tribromomethylsulfonyl)benzothiazole); and merocyanine dyes such as 3-ethyl-5[(3-ethyl-2-benzothiasolinylidene)-1-methylethylidene]-2-thio-2,4-oxazolidineodine; phthalazinone and phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives (e.g., phthalic acid, 4-methylphthalic acid, 4-nitrophthalic acid, and tetrachlorophthalic anhydride); quinazolinediones, benzoxazine or naphthoxazine derivatives; rhodium complexes functioning not only as tone modifiers, but also as sources of halide ion for silver halide formation in situ, such as ammonium hexachlororhodate (III), rhodium bromide, rhodium nitrate and potassium hexachlororhodate (III); inorganic peroxides and persulfates (e.g., ammonium peroxydisulfate and hydrogen peroxide); benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymmetric triazines (e.g., 2,4-dihydroxypyrimidine, 2-hydroxy-4-aminopyrimidine), azauracils, and tetrazapentalene derivatives (e.g., 3,6-dimercapto-1,4-diphenyl-1H,4H-2,3a,5,6a-tetrazapentalene, and 1,4-di(o-chlorophenyl)-3,6-dimercapto-1H, 4H-2,3a,5,6a-tetrazapentalene).

A number of methods are known in the art for obtaining color images with dry silver systems including: a combination of silver benzotriazole, well known magenta, yellow and cyan dye-forming couplers, aminophenol developing agents, a base release agent such as guanidinium trichloroacetate and silver bromide in poly(vinyl butyral) as described in U.S. Pat. Nos. 4,847,188 and 5,064,742; preformed dye release systems such as those described in U.S. Pat. No. 4,678,739; a combination of silver bromoiodide sulfonamidophenol reducing agent, silver behenate, poly(vinyl butyral), an amine such as n-octadecylamine and 2-equivalent or 4-equivalent cyan, magenta or yellow dye-forming couplers; leuco dye bases which oxidize to form a dye image (e.g., Malachite Green, Crystal Violet and pararosaniline); a combination of in situ silver halide, silver behenate, 3-methyl-1-phenylpyrazolone and N,N'-dimethyl-p-phenylenediamine hydrochloride; incorporating phenolic leuco dye reducing agents such as 2(3,5-di-(t-butyl)-4-hydroxyphenyl)-4,5-diphenylimidazole, and bis(3,5-di-(t-butyl)-4-hydroxyphenyl)phenylmethane, incorporating azomethine dyes or azo dye reducing agents; silver dye bleach processes (for example, an element comprising silver behenate, behenic acid, poly(vinyl butyral), poly(vinyl-butyral) peptized silver bromoiodide emulsion, 2,6-dichloro-4-benzenesulfonamidophenol, 1,8-(3,6-diazaoctane)bis(isothiuronium-p-toluenesulfonate) and an azo dye can be exposed and heat processed to obtain a negative silver image with a uniform distribution of dye, and then laminated to an acid activator sheet comprising polyacrylic acid, thiourea and p-toluenesulfonic acid and heated to obtain well defined positive dye images); and amines such as aminoacetanilide (yellow dye-forming), 3,3'-dimethoxybenzidine (blue dye-forming) or sulfanilide (magenta dye forming) that react with the oxidized form of incorporated reducing agents such as 2,6-dichloro-4-benzenesulfonamidophenol to form dye images. Neutral dye images can be obtained by the addition of amines such as behenylamine and p-anisidine.

Leuco dye oxidation in such silver halide systems for color formation is disclosed in U.S. Pat. Nos. 4,021,240, 4,374,821, 4,460,681 and 4,883,747.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylenediamine with a phenolic or anilinic compound. Leuco dyes of this class are described in U.S. Pat. No. 4,594,307. Leuco chromogenic dyes having short chain carbamoyl protecting groups are described in assignee's copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Patent No. 52-89131 and U.S. Pat. Nos. 2,784,186; 4,439,280; 4,563,415, 4,570,171, 4,622,395, and 4,647,525, all of which are incorporated herein by reference.

Another class of dye releasing materials that form a dye upon oxidation are known as preformed-dye-release (PDR) or redox-dye-release (RDR) materials. In these materials the reducing agent for the organic silver compound releases a pre-formed dye upon oxidation. Examples of these materials are disclosed in Swain, U.S. Pat. No. 4,981,775, incorporated herein by reference.

The optional leuco dyes of this invention, can be prepared as described in H. A. Lubs *The Chemistry of Synthetic Dyes and Pigments*; Hafner; New York, NY; 1955 Chapter 5; in H. Zollinger *Color Chemistry: Synthesis, Properties and Applications of Organic Dyes and Pigments;* VCH; New York, N.Y.; pp. 67–73, 1987, and in U.S. Pat. No. 5,149,807; and EPO Laid Open Application No. 0,244,399.

Silver halide emulsions containing the stabilizers of this invention can be protected further against the additional production of fog and can be stabilized against loss of sensitivity during shelf storage. Suitable antifoggants, stabilizers, and stabilizer precursors which can be used alone or in combination, include thiazolium salts as described in U.S. Pat. Nos. 2,131,038 and 2,694,716; azaindenes as described in U.S. Pat. Nos. 2,886,437 and 2,444,605; mercury salts as described in U.S. Pat. No. 2,728,663; urazoles as described in U.S. Pat. No. 3,287,135; sulfocatechols as described in U.S. Pat. No. 3,235,652; oximes as described in British Patent No. 623,448; nitrones; nitroindazoles; polyvalent metal salts as described in U.S. Pat. No. 2,839,405; thiouronium salts as described in U.S. Pat. No. 3,220,839; and palladium, platinum and gold salts described in U.S. Pat.

Nos. 2,566,263 and 2,597,915; halogen-substituted organic compounds as described in U.S. Pat. Nos. 4,108,665 and 4,442,202; triazines as described in U.S. Pat. Nos. 4,128,557; 4,137,079; 4,138,265; and 4,459,350; and phosphorous compounds as described in U.S. Pat. No. 4,411,985.

Stabilized emulsions of the invention can contain plasticizers and lubricants such as polyalcohols (e.g., glycerin and diols of the type described in U.S. Pat. No. 2,960,404); fatty acids or esters such as those described in U.S. Pat. No. 2,588,765 and U.S. Pat. No. 3,121,060; and silicone resins such as those described in British Patent No. 955,061.

The photothermographic elements of the present invention may include image dye stabilizers. Such image dye stabilizers are illustrated by British Patent No. 1,326,889; U.S. Pat. Nos. 3,432,300; 3,698,909; 3,574,627; 3,573,050; 3,764,337 and 4,042,394.

Photothermographic elements containing emulsion layers stabilized according to the present invention can be used in photographic elements which contain light absorbing materials and filter dyes such as those described in U.S. Pat. Nos. 3,253,921; 2,274,782; 2,527,583 and 2,956,879. If desired, the dyes can be mordanted, for example, as described in U.S. Pat. No. 3,282,699.

Photothermographic elements containing emulsion layers stabilized as described herein can contain matting agents such as starch, titanium dioxide, zinc oxide, silica, polymeric beads including beads of the type described in U.S. Pat. No. 2,992,101 and U.S. Pat. No. 2,701,245.

Emulsions stabilized in accordance with this invention can be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056 and 3,206,312 or insoluble inorganic salts such as those described in U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymers are polyvinyl butyral, butyl ethyl cellulose, methacrylate copolymers, maleic anhydride ester copolymers, polystyrene, and butadiene-styrene copolymers.

Optionally, these polymers may be used in combinations of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing a stabilizer according to the present invention may be coated on a wide variety of supports. Typical supports include polyester film, subbed polyester film, poly(ethylene terephthalate)film, cellulose nitrate film, cellulose ester film, poly(vinyl acetal) film, polycarbonate film and related or resinous materials, as well as glass, paper metal and the like. Typically, a flexible support is employed, especially a paper support, which may be partially acetylated or coated with baryta and/or an α-olefin polymer, particularly a polymer of an α-olefin containing 2 to 10 carbon atoms such as polyethylene, polypropylene, ethylene-butene copolymers and the like. Substrates may be transparent or opaque.

Substrates with a backside resistive heating layer may also be used in color photothermographic imaging systems such as shown in U.S. Pat. Nos. 4,460,681 and 4,374,921.

Photothermographic emulsions of this invention can be coated by various coating procedures including dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095.

Additional layers may be incorporated into photothermographic articles of the present invention such as dye receptive layers for receiving a mobile dye image, an opacifying layer when reflection prints are desired, a protective topcoat layer and a primer layer as is known in the photothermographic art. Additionally, it may be desirable in some instances to coat different emulsion layers on both sides of a transparent substrate, especially when it is desirable to isolate the imaging chemistries of the different emulsion layers.

The present invention will be illustrated in detail in the following examples, but the embodiment of the present invention is not limited thereto.

EXAMPLES

These examples provide exemplary synthetic procedures for compounds of the invention. Photothermographic imaging constructions are shown. The scope of the invention is not to be limited to the specific examples.

All materials used in the following examples were readily available from standard commercial sources such as Aldrich Chemical Co. (Milwaukee, Wis.) unless otherwise specified. The following additional terms and materials were used.

Acryloid TM B-66 is a poly(methyl methacrylate) available from Rohm and Haas.

Airvol TM 523 is a poly(vinyl alcohol) available from Air Products.

Butvar TM B-76 is a poly(vinyl butyral) available from Monsanto Company, St. Louis, Mo.)

$HgC_2H_3O_2$ is mercuric acetate

MEK is methyl ethyl ketone (2-butanone).

PAZ is 1-(2H)-phthalazinone

PET is poly(ethylene terephthalate)

PVP K-90 is a poly(vinyl pyrrolidone) available from International Specialty Products.

Styron TM 685 is a polystyrene resin available from Dow Chemical Company.

VAGH TM is a vinyl chloride/vinyl acetate copolymer available from Union Carbide Corp.

Dye A is disclosed in U.S. Pat. No. 4,476,220 and has the following formula:

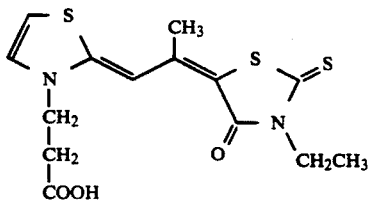

Dye B is disclosed in U.S. Pat. No. 4,123,282 and has the following formula:

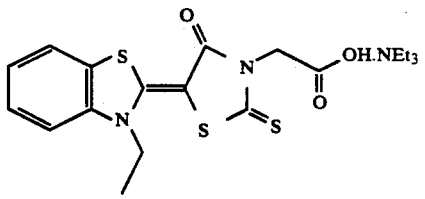

Dye C is a leuco yellow dye disclosed in U.S. Pat. No. 4,923,792 and has the following formula:

Dye C

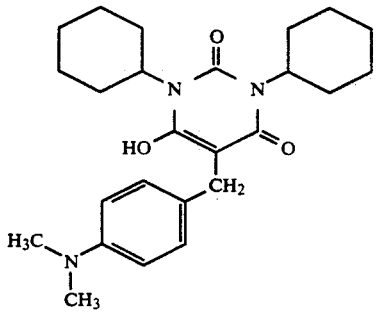

"Ethyl ketazine" is a leuco magenta dye disclosed in U.S. Pat. No. 4,795,697 and has the following formula:

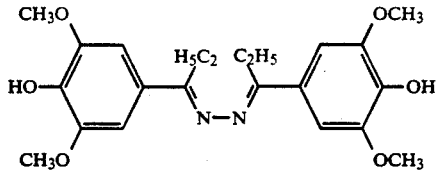

The following procedure is representative of the method of preparation of the stabilizers of the instant invention.

Preparation of Compound 1: To a solution of methylamine hydrochloride (202.6 g, 3.0 mol) and acetone (242 mL, 3.3 mol) in water (500 mL) was added a solution of sodium cyanide (147 g, 3.0 mol) in water (400 mL) dropwise with stirring. The temperature of the reaction mixture was kept below 45° C. by occasional cooling with an ice bath. When addition was complete, the reaction mixture was left at room temperature overnight. The mixture was then stirred and cooled to 5° C. while acryloyl chloride (244 mL, 3.0 mol) and an aqueous solution of sodium hydroxide (120 g, 3.0 mol, in 150 mL of water) were added separately and simultaneously. The temperature of the reaction mixture was kept below 10° C. during the addition. When addition was complete, the reaction mixture was stirred an additional 4 hr. Ethyl acetate (500 mL) was then added, the layers separated, and the aqueous layer extracted with 2 additional portions of ethyl acetate (500 mL). The organic layers were combined, washed successively with saturated aqueous solutions of sodium bicarbonate and sodium chloride (200 mL each). The solution was dried over anhydrous magnesium sulfate, filtered, and solvent evaporated to afford N-acryloyl-N-methyl-2-aminoisobutyronitrile (397 g) as a yellow oil which crystallized on standing.

A mixture of benzimidazole (23.6 g, 0.20 mol) and N-acryloyl-N-methyl-2-aminoisobutyronitrile (30.4 g, 0.20 mol) were heated neat at 100° C. overnight and the product recrystallized from water containing a small amount of ethanol. Spectral analysis confirmed the identity of the product as Compound 1.

Preparation of Compound 11: A mixture of theophylline (28.6 g, 0.16 mol), N-acryloyl-N-methyl-2-aminoisobutyronitrile (24.1 g, 0.16 mol) and 1,8-diazabicyclo[5.4.0]undec-7-ene (75 mg, 0.50 mmol) was heated at 100° C. for 4 days. The product was recrystallized from aqueous ethanol. Spectral analysis confirmed the product as Compound 11.

Evaluation of Stabilizers

Densitometry measurements were made on a custom built computer scanned densitometer and are believed to be comparable to measurements obtainable from commercially available densitometers.

The following definitions are used in the sensitometry measurements.

$Spd_2$ is the log exposure corresponding to a density of 0.60 above Dmin $Toe_2$ is the slope of the line joining the density points at 0.50 log E and 0.25 log E before the log E value corresponding to a density of 0.30 above Dmin.

$AC_2$ is the slope of the line joining the density points of 0.60 and 1.20 above Dmin.

The Green filter used was a Wratten #58.

The Blue filter used was a Wratten #47B.

EXAMPLE 1

The following ingredients were mixed in a pint jar:

| | |
|---|---|
| Silver Soap | 3.0410 g |
| Toluene | 24.6318 g |
| Acetone | 2.7369 g |
| Butvar TM B-76 | 0.0242 g |

The resulting dispersion was homogenized. Using a metal stirring rod, the following ingredients were added to the dispersion with stirring in the order listed:

| Material | Amount |
|---|---|
| $HgC_2H_3O_2$ | 0.0299 g |
| Methanol | 0.5913 g |
| $CaBr_2.2H_2O$ | 0.0334 g |
| Ethanol | 1.0010 g |
| $CaBr_2.2H_2O$ | 0.0334 g |
| Ethanol | 1.0010 g |
| Butvar TM B-76 | 4.0193 g |

The following ingredients were combined in a 4 ounce jar, and upon dissolving were added to the above dispersion:

| | |
|---|---|
| Ethyl Ketazine | 0.6090 g |
| Phthalazinone | 0.9157 g |
| Tetrahydrofuran | 44.1606 g |
| 2-butanone | 4.4161 g |
| Union Carbide VAGH TM | 2.2063 g |
| Butvar TM B-76 | 9.3879 g |
| Dye A | 0.0006 g |
| Ethanol | 1.1608 g |

To 10.0 g of the resulting mixture, the following were added:

A. Nothing. This sample contains no stabilizer and serves as a control.

B. 0.0732 g of stabilizer Compound 1 in 1.00 mL methanol

C. 0.105 g of stabilizer Compound 7 in 1.00 mL methanol

D. 0.040 g of stabilizer Compound 11 in 2.00 mL methanol

The first and second coatings were applied simultaneously at 2.0 mil (0.05 mm) wet thickness each. The web was then dried for 5 minutes at 180° F. (82.2° C.).

Samples from the coating were exposed to an EG&G sensitometer for $10^{-3}$ seconds through a Wratten 58 green filter and a 0–3 continuous density wedge. The samples were then processed for approximately six seconds by heating at 135° C.

The following sensitometric data were obtained from the sample:

| Sample ID | Filter | Dmin | Dmax | $Spd_2$ | $Toe_2$ | $AC_2$ |
|---|---|---|---|---|---|---|
| A | Green | 0.10 | 1.96 | 2.22 | 0.81 | 2.29 |
| | Blue | 0.10 | 1.03 | 2.20 | 0.67 | — |
| B | Green | 0.14 | 1.35 | 2.66 | 0.69 | 0.61 |
| | Blue | 0.12 | 0.59 | — | 0.46 | — |
| C | Green | 0.13 | 0.95 | 3.07 | 0.83 | — |
| | Blue | 0.13 | 0.47 | — | 0.61 | — |
| D | Green | 0.10 | 1.78 | 2.45 | 0.83 | 1.86 |
| | Blue | 0.10 | 0.93 | 2.35 | 0.60 | — |

Post-processing stability was measured by exposing the samples to 1200 foot-candles of light for 48 hours at 65% relative humidity and 27° C. The absolute Dmin measurements following this test were:

| Filter | A | B | C | D |
|---|---|---|---|---|
| Green | 0.39 | 0.19 | 0.22 | 0.31 |
| Blue | 0.54 | 0.21 | 0.25 | 0.39 |

EXAMPLE 2

To 10.0 g of a silver soap dispersion prepared as in Example 1 above, were added:

E. Nothing. This sample contains no stabilizer and serves as a control.

F. 0.0656 g of stabilizer compound 2 in 1.00 mL methanol

A second coating solution comprised the following ingredients:

| | |
|---|---|
| Toluene | 36.0 g |
| 2-butanone | 36.0 g |
| Stryon TM 685 | 24.67 g |
| Acryloid TM B-66 | 3.33 g |

The first and second coatings were applied simultaneously at 2.0 mil (50.8 μm) wet thickness each. The web was then dried for five minutes at 180° F. (82° C.).

Samples from the coating were exposed to an EG&G sensitometer for $10^{-3}$ seconds through a Wratten 58 green filter and 0–3 continuous density wedge. The samples were then processed for approximately six seconds at 135° C. in a 3M Model 9014 Hot Roll Processor. The following sensitometric data were obtained from the sample:

| Sample ID | Filter | Dmin | Dmax | $Spd_2$ | $Toe_2$ | $AC_2$ |
|---|---|---|---|---|---|---|
| E | Green | 0.11 | 1.72 | 2.07 | 0.71 | 1.38 |
| | Blue | 0.12 | 0.92 | 2.26 | 0.50 | — |
| F | Green | 0.58 | 1.79 | 2.07 | 0.57 | 1.38 |
| | Blue | 0.36 | 0.94 | — | 0.40 | — |

Post Processing Stability was measured by exposing the samples to 1200 foot-candles of light for 24 hours at 65% relative humidity and 27° C. The absolute Dmin measurements following this test were:

| Filter | E | F |
|---|---|---|
| Green | 0.26 | 0.38 |
| Blue | 0.33 | 0.33 |

EXAMPLE 3

The following ingredients were mixed in a pint jar:

| | |
|---|---|
| Silver Soap | 2.1540 g |
| Toluene | 17.4472 g |
| Acetone | 1.9386 g |

The resulting dispersion was homogenized. Using a metal stirring rod, the following ingredients were added to the dispersion:

| | |
|---|---|
| 2-butanone | 13.5553 g |
| Isopropanol | 18.5531 g |
| Butvar B-76 | 0.0663 g |

| Material | Amount |
|---|---|
| Pyridine | 0.0161 g |
| 2-butanone | 0.1161 g |
| $HgBr_2$ | 0.0235 g |
| Ethanol | 0.3395 g |
| $CaBr_2.2H_2O$ | 0.0308 g |
| Ethanol | 0.9167 g |
| PVP K-90 | 3.6078 g |
| Butvar B-76 | 4.0193 g |

To the resulting dispersion the following were added:

| | |
|---|---|
| Dye B | 0.0019 g |
| Toluene | 1.1059 g |
| Ethanol | 3.3177 g |

After 30 minutes, the following ingredients were added to a glass jar, and upon dissolving, were added to 67.7003 g of the silver premix:

| | |
|---|---|
| Tribenzylamine | 0.6703 g |
| Phthalazinone | 0.1959 g |
| Ethanol | 15.3136 g |
| 2-butanone | 15.3136 g |
| Dye-C | 0.8063 g |

To 9.90 g of the resulting mixture, the following were added:

G. Nothing. This sample contains no stabilizer and serves as a control.

H. 0.100 g of stabilizer Compound 9 in 0.500 mL tetrahydrofuran and 0.500 mL methanol J. 0.201 g of stabilizer Compound 9 in 0.500 mL tetrahydrofuran and 0.500 mL methanol K. 0.105 g of stabilizer Compound 7 in 0.500 mL tetrahydrofuran and 0.500 mL methanol L. 0.210 g of stabilizer Compound 7 in 0.500 mL tetrahydrofuran and 0.500 mL methanol The samples were coated at 2.9 mil (73.7 micrometers) wet thickness and dried 4.5 minutes at 180° F. (82.2° C.).

A second coating solution was prepared in the following manner:

| | |
|---|---|
| Airvol TM 523 | 51.1407 g |
| Water | 324.8546 g |

The suspension was stirred with heating until the polymer was fully dissolved. The resulting solution was cooled to below 40° C. and the following were added:

| | |
|---|---|
| Methanol | 305.4030 g |
| Phthalazine | 0.4179 g |
| Benzotriazole | 0.0056 g |
| Tetrachlorophthalic anhydride | 0.4298 g |
| Methanol | 9.4752 g |
| Sodium Acetate | 2.4500 g |

The resulting solution was then coated at 3.8 mils wet and dried 4.5 minutes at 180° F. (82.2° C.).

Samples from the coating were exposed to an EG&G sensitometer for $10^{-3}$ seconds through Wratten 47B blue filter and 0–3 continuous density wedge. The exposed strips were processed for approximately six seconds in a 3M Model 9014 Hot Roll Processor. The following sensitometry was obtained from the samples:

| Sample ID | Filter | Dmin | Dmax | Spd2 | Toe2 | AC2 |
|---|---|---|---|---|---|---|
| G | Blue | 0.07 | 2.45 | 2.14 | 0.83 | 6.31 |
| H | Blue | 0.08 | 2.48 | 2.18 | 0.85 | 7.42 |
| J | Blue | 0.08 | 2.20 | 2.33 | 0.90 | 6.74 |
| K | Blue | 0.08 | 2.49 | 2.02 | 0.86 | 7.61 |
| L | Blue | 0.07 | 2.35 | 2.09 | 0.93 | 6.72 |

Post Processing Stability was measured by exposing the samples to 100 foot-candles of light for 7 days at 80% relative humidity and 27° C. The absolute Dmin measurements following this test were:

| Sample ID | Dmin |
|---|---|
| G | 1.10 |
| H | 0.75 |
| J | 0.69 |

-continued

| Sample ID | Dmin |
|---|---|
| K | 0.49 |
| L | 0.37 |

What is claimed is:

1. A photothermographic composition comprising a photographic silver halide, an organic silver salt, a reducing agent for the organic silver salt, and a stabilizer having a nucleus of the formula:

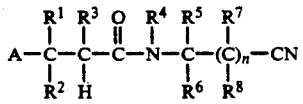

wherein

A represents a post-processing stabilizer in which a hydrogen atom of the post-processing stabilizer (AH) has been replaced by

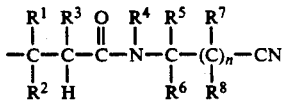

$R^1$, $R^2$, and $R^3$, are independently hydrogen or methyl and with the proviso that $R^1$ can represent aryl group when $R^2$ and $R^3$ are hydrogen;

$R^4$ is hydrogen or a lower alkyl group of from 1 to 4 carbon atoms;

$R^5$ and $R^6$ independently represent hydrogen, an alkyl group, a cycloalkyl group or, an aryl group;

$R^7$ and $R^8$ are independently hydrogen or lower alkyl groups of 1 to 4 carbon atoms; and n is 0 or 1.

2. The composition of claim 1 wherein AH is selected from the group consisting of benzimidazoles, triazoles, benzotriazoles, tetrazoles, triazines, thiazolines, 3-pyrazolidinones, indazoles, hypoxanthines, and imidazoles.

3. The composition of claim 1 wherein AH is selected from the group consisting of benzimidazoles, triazoles, benzotriazoles, tetrazoles, 1-phenyl-3-pyrazolidinones and imidazoles.

4. The composition of claim 1 adhered to a substrate as at least one layer.

5. A photothermographic composition comprising one layer or two adjacent layers coated on a substrate wherein the photothermographic composition comprises a photographic silver halide, an organic silver salt, and a reducing agent for the organic silver salt, an organic polymeric binder and a compound having the formula:

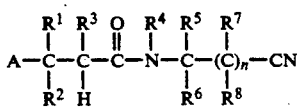

wherein

A represents a post-processing stabilizer in which a hydrogen atom of the post-processing stabilizer (AH) has been replaced by

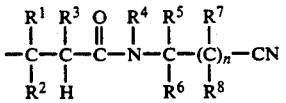

$R^1$, $R^2$, and $R^3$, are independently hydrogen or methyl and with the proviso that $R^1$ can represent an aryl group when $R^2$ and $R^3$ are hydrogen;

$R^4$ is hydrogen or a lower alkyl group of from 1 to 4 carbon atoms;

$R^5$ and $R^6$ independently represent hydrogen, an alkyl group, a cycloalkyl group, or an aryl group;

$R^7$ and $R^8$ are independently hydrogen or lower alkyl groups of 1 to 4 carbon atoms; and n is 0 or 1.

6. The composition of claim 5 wherein AH is selected from the group consisting of benzimidazoles, imidazoles, triazoles, benzotriazoles, piperidones, purines, indazoles, thiazolines, 3-pyrazolidinones, triazines, tetrazaindenes, hypoxanthines, and tetrazoles.

7. The composition of claim 5 wherein AH is selected from the group consisting of benzimidazoles, triazoles, benzotriazoles, tetrazoles, 1-phenyl-3-pyrazolidinones and imidazoles.

8. A photothermographic composition comprising a photographic silver halide, an organic silver salt, a reducing agent for the organic silver salt, and a stabilizer having a nucleus of the formula:

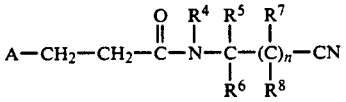

wherein:

A represents any monovalent group for which the corresponding compound AH functions as a post-processing stabilizer.

$R^4$ is hydrogen or a lower alkyl group of from 1 to 4 carbon atoms;

$R^5$ and $R^6$ independently represent hydrogen, an alkyl group, a cycloalkyl group, or an aryl group;

$R^7$ and $R^8$ are independently hydrogen or lower alkyl groups of 1 to 4 carbon atoms; and n is 0 or 1.

9. The composition of claim 8 wherein AH is selected from the group consisting of benzimidazoles, triazoles, benzotriazoles, tetrazoles, triazines, thiazolines, 3-pyrazolidinones, indazoles, hypoxanthines, and imidazoles.

10. The composition of claim 9 wherein AH is selected from the group consisting of benzimidazoles, triazoles, benzotriazoles, tetrazoles, 1-phenyl-3-pyrazolidinones and imidazoles.

11. The composition of claim 8 adhered to a substrate as at least one layer.

12. The composition of claim 9 adhered to a substrate as at least one layer.

13. The composition of claim 10 adhered to a substrate as at least one layer.

14. A photothermographic composition comprising one layer or two adjacent layers coated on a substrate wherein the photothermographic composition comprises a photographic silver halide, an organic silver salt, a reducing agent for the organic silver salt, and a compound having the formula:

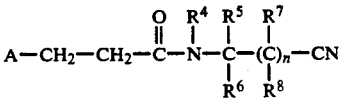

wherein:

A represents any monovalent group for which the corresponding compound AH functions as a post-processing stabilizer.

$R^4$ is hydrogen or a lower alkyl group of from 1 to 4 carbon atoms;

$R^5$ and $R^6$ independently represent hydrogen, an alkyl group, a cycloalkyl group, or an aryl group;

$R^7$ and $R^8$ are independently hydrogen or lower alkyl groups of 1 to 4 carbon atoms; and n is 0 or 1.

15. The composition of claim 14 wherein AH is selected from the group consisting of benzimidazoles, imidazoles, triazoles, benzotriazoles, piperidones, purines, indazoles, thiazolines, 3-pyrazolidinones, triazines, tetrazaindenes, hypoxanthines, and tetrazoles.

16. The composition of claim 14 wherein AH is selected from the group consisting of benzimidazoles, triazoles, benzotriazoles, tetrazoles, 1-phenyl-3-pyrazolidinones and imidazoles.

17. The composition of claim 2 wherein A is attached to the group replacing said hydrogen atom through a nitrogen atom of group A.

* * * * *